US010493447B2

(12) United States Patent
Mangiafico et al.

(10) Patent No.: US 10,493,447 B2
(45) Date of Patent: Dec. 3, 2019

(54) SPECIMEN CUP AND TRANSFER APPARATUS

(71) Applicant: ALLEGIANCE CORPORATION, Chicago, IL (US)

(72) Inventors: Emanuele A Mangiafico, Farmington, CT (US); Darin Senna, Portland, CT (US); David Facchini, Farmington, CT (US); Andrew Cervasio, Sarasota, FL (US)

(73) Assignee: ALLEGIANCE CORPORATION, Chicago, IL (US)

( * ) Notice: Subject to any disclaimer, the term of this patent is extended or adjusted under 35 U.S.C. 154(b) by 301 days.

(21) Appl. No.: 14/831,738

(22) Filed: Aug. 20, 2015

(65) Prior Publication Data

US 2017/0050184 A1 Feb. 23, 2017

(51) Int. Cl.
*B01L 3/00* (2006.01)

(52) U.S. Cl.
CPC ..... *B01L 3/502* (2013.01); *B01L 3/561* (2013.01); *B01L 2200/0615* (2013.01); *B01L 2300/041* (2013.01); *B01L 2300/046* (2013.01); *B01L 2300/0672* (2013.01); *B01L 2300/0832* (2013.01)

(58) Field of Classification Search
CPC .. B01L 3/502; B01L 3/561; B01L 2300/0672; B01L 2300/046; B01L 2200/0615; B01L 2300/0832; B01L 2300/041
See application file for complete search history.

(56) References Cited

U.S. PATENT DOCUMENTS

| | | | | |
|---|---|---|---|---|
| D303,428 | S | 9/1989 | Wada | |
| 6,358,232 | B1 | 3/2002 | Hand et al. | |
| D481,313 | S | 10/2003 | Archer | |
| 6,635,028 | B1 | 10/2003 | Ielpo et al. | |
| D481,946 | S | 11/2003 | Nicholson et al. | |
| 7,007,817 | B2 | 3/2006 | Jochem | |
| RE39,457 | E * | 1/2007 | Guirguis | A61B 10/007 422/419 |
| D610,700 | S | 2/2010 | Khoury | |
| D690,826 | S | 10/2013 | Kuroda et al. | |
| D717,462 | S | 11/2014 | Wainwright et al. | |
| D717,469 | S | 11/2014 | Nemeth | |
| 9,033,194 | B1 | 5/2015 | Grabowski et al. | |
| D731,672 | S | 6/2015 | Kuroda et al. | |
| D759,836 | S | 6/2016 | Wainwright et al. | |

(Continued)

*Primary Examiner* — Samuel P Siefke

(57) ABSTRACT

An apparatus for collecting, storing and transferring a liquid specimen includes a first cup for collecting a liquid specimen and a lid attachable to the first cup for closing an opening in the first cup. The lid defines a protruding collar, the lid and the collar define an aperture extending through the lid and a length of the collar. The apparatus further includes a transfer assembly including a tube having first and second ends, the first end defining a point, the second end configured for insertion through the aperture in the collar for transferring a liquid specimen from the first cup through the tube. The first end of the tube extends through a bottom of a second cup and into the second cup. The first end of the tube configured for insertion into an evacuated vial for transferring a liquid specimen from the first cup to the vial.

16 Claims, 4 Drawing Sheets

(56) References Cited

U.S. PATENT DOCUMENTS

| | | | | |
|---|---|---|---|---|
| 2003/0164051 | A1* | 9/2003 | Kunimune | A61B 10/007 73/863.23 |
| 2013/0175266 | A1* | 7/2013 | Ellis | A61B 10/007 220/23.87 |

* cited by examiner

SPECIMEN CUP AND TRANSFER APPARATUS

FIELD OF THE INVENTION

The present disclosure relates to an apparatus for collecting, storing and transferring a liquid specimen.

BACKGROUND OF THE INVENTION

The statements in this section merely provide background information related to the present disclosure and may not constitute prior art.

Fluid biological specimens are routinely collected and analyzed for a variety of medical and other purposes. It is commonplace for a patient visiting a medical facility for evaluation and/or treatment to be asked to deposit a urine specimen in a cup and provide that specimen to a medical professional for testing. It is also increasingly common for athletes involved in competitive sports to be required to provide a urine specimen which may be divided into two or more sample vials in order to test those athletes for illegal performance enhancing drugs or practices such as doping. More than one sample of the specimen is typically taken from the cup and preserved in the event that the results of one sample analysis are inconclusive or to provide additional evidence of a particular result. Of course it is not only athletes who may undergo testing via urine analysis wherein the specimens must be protected from contamination starting from collection in a cup throughout transfer and analysis of specimen samples. Thus, it is often necessary to prevent spillage or contamination of liquid specimens throughout any transport of the specimen or transfer thereof to another container(s).

Most currently used specimen cups do not provide apparatus for transferring of a liquid specimen to a vial or other container for laboratory testing of the specimen.

Accordingly, it is an object of the present disclosure to provide an apparatus for collecting, storing and transferring a liquid specimen that improves over prior art devices.

SUMMARY OF THE INVENTION

This section provides a general summary of the disclosure and does not provide a comprehensive description or include full scope or all the features of the subject matter disclosed.

According to one aspect, the present teachings provide a specimen collection, transportation, storage and transfer apparatus including a specimen cup for collecting a specimen, and a lid attachable to the specimen cup for closing an opening in the specimen cup. The lid defining a collar protruding therefrom, the lid and the collar collectively defining an aperture extending through the lid and a length of the collar. The apparatus further includes a transfer assembly including a tube having first and second ends, the first end defining a point, the second end configured for insertion through the aperture in the collar for transferring a liquid specimen from the specimen cup through the tube. A transfer cup having a bottom and defining an open top is attached to the first end of the tube, the tube extending through the bottom of, and into the transfer cup. The first end of the tube configured for insertion into an evacuated vial for transferring a liquid specimen from the specimen cup to the vial. The collar being configured to support the tube in an upright position relative to the specimen cup when the tube is inserted through the collar and into the specimen cup.

Optionally, a seal may cover the aperture in the lid when the tube is not coupled to the lid.

In one embodiment, the lid includes a generally concave enter portion extending substantially across a diameter of the lid, the aperture disposed through the lid may be positioned away from the center of the lid such that potential spillage of the specimen may be contained on the center of the lid surface and does not contaminate the aperture.

In another aspect of the disclosed invention, the tube includes a needle attached to an end thereof end for piercing a seal of a vial to which a specimen is to be transferred.

Further areas of applicability will become apparent from the description provided herein. The description and specific examples in this summary are intended for purposes of illustration only and are not intended to limit the scope of the disclosure.

BRIEF DESCRIPTION OF THE DRAWINGS

The present teachings will become more fully understood from the detailed description, the appended claims and the following drawings. The drawings are for illustrative purposes only and are not intended to limit the scope of the present disclosure.

DETAILED DESCRIPTION OF EMBODIMENTS OF THE INVENTION

Figure 1:
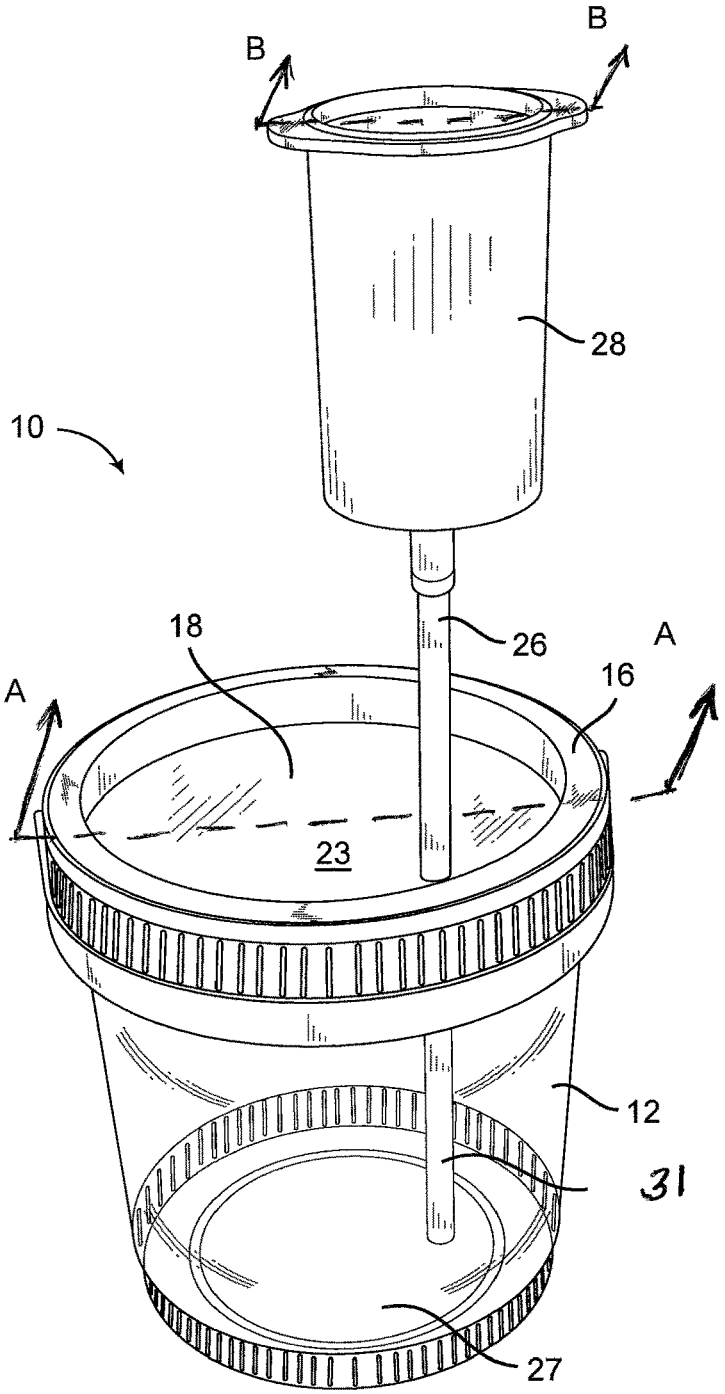
FIG. 1 is a perspective view of one embodiment of a specimen collection and transfer apparatus in accordance with the present invention.

Detailed illustrative descriptions of example embodiments are disclosed herein. However, specific structural and functional details disclosed herein are merely representative for purposes of describing example embodiments. The example embodiments may be embodied in many alternate forms and should not be construed as limited to only the example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

FIGS. 1-6 illustrate example embodiments of a specimen collection, storage and transfer apparatus 10 according to the present invention. A specimen cup 12 provides a receptacle into which a liquid specimen, for example urine, is deposited through an opening 14 in the top of the specimen cup. As well known in the art, the specimen cup 12 defines a threaded portion 15 surrounding the opening 14 for engaging a lid 16 having a complementary threaded portion 17. The apparatus 10 includes the lid 16 for sealing the opening 14 and retaining a liquid specimen in the specimen cup 12. In the illustrated embodiment, the lid 16 includes a concave center portion 18 extending substantially across a diameter of the lid for covering the entirety of the opening 14 of the specimen cup 12. A collar 20 is formed integral with the center portion 18 and protrudes outwardly from a bottom side 19 of the center portion 18. An aperture 22 extends through the lid 16 and the collar 20. The center portion 18 is generally smooth surrounding the aperture 22 for receiving a seal thereon. In one embodiment, the aperture 22 is approximately 3.175 millimeters (3.175 mm) in diameter, D. In other embodiments, depending on the size of the specimen cup 12 and the application, a diameter of the aperture 22 may be in a range between about two millimeters (2 mm) to about one centimeter (1 cm). The aperture 22 is defined collectively by the center portion 18 and the collar 20. In the illustrated embodiments, the lid 16 and collar 20 is formed of plastic. However, in other embodiments the lid may be formed of other types of materials.

Figure 2:
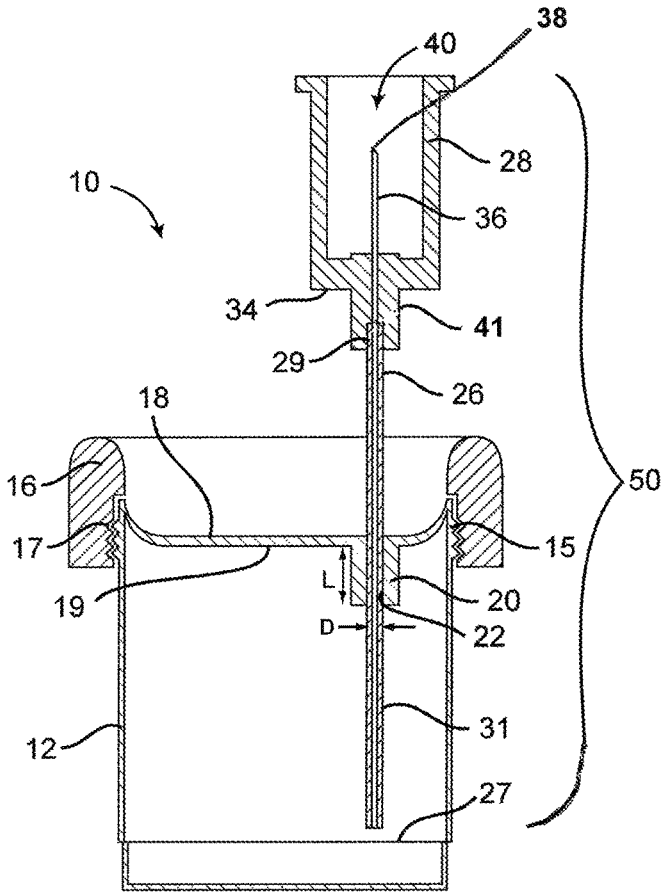
FIG. 2 is a sectional side view of the apparatus of FIG. 1 taken at lines A-A and B-B of FIG. 1.
Figure 3:
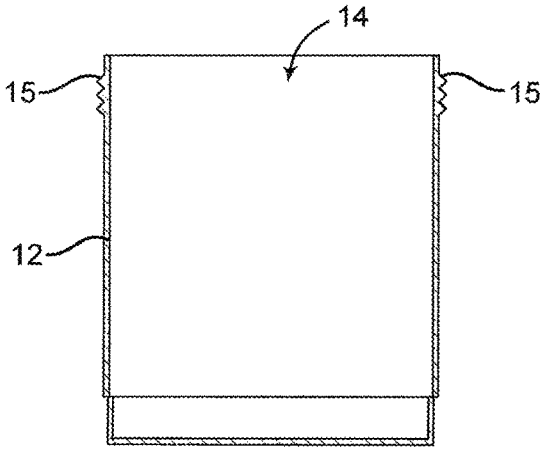
FIG. 3 is a sectional side view of the specimen cup of the apparatus of FIG. 1 taken at lines A-A of FIG. 1.

As shown in FIG. 2, the collar 20 extends below the center portion 18 of the lid a length L which averages about 5 mm. Due to the concave shape of the center portion 18, the length L of the collar 20 extending below the center portion is not uniform about a circumference of the collar. In other embodiments, the length L of the collar extending below the center portion 18 of the lid may be in a range of about 3 millimeters to about 2 centimeters or more depending on the size of the container and/or a tube 26 of the transfer assembly 50 (described further hereinbelow). The collar 20 being configured to support the tube 26 of the transfer assembly in an upright position as shown in FIG. 2.

Figure 6:
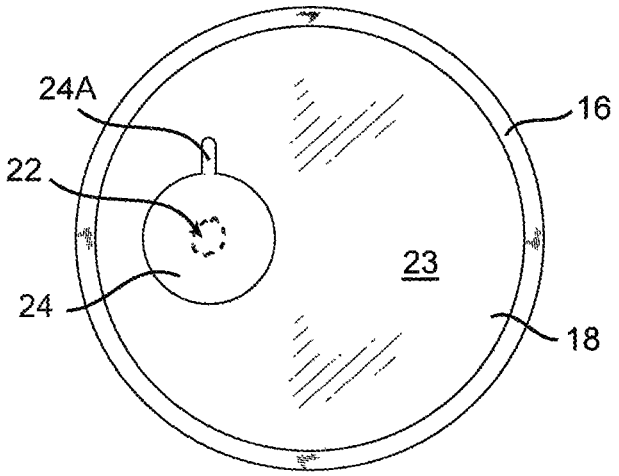
FIG. 6 is a top view of another embodiment of a lid for a specimen cup and a seal attached to the lid according to the present invention.

Referring to FIG. 6, in one embodiment, the apparatus 10 further includes a seal 24 for removably covering and providing an airtight and leak proof seal over the aperture 22. The aperture 22 may be sealed with an adhesive seal 24 covering the aperture. In one embodiment, the seal 24 is formed of a circular shaped plastic material having a reusable adhesive disposed on one side thereof for removable attachment to an upper surface 23 of the center portion 18 of lid 16 surrounding the aperture 22. As shown in FIG. 1, the surface 23 is smooth in part for receiving the seal 24 and facilitating a secure coupling therewith for retaining a liquid specimen in the specimen cup 12 even in the event the specimen cup 12 is tipped over or shaken while a liquid specimen is stored therein.

In one embodiment, the aperture 22 has a diameter D of approximately 3.175 (3.175 mm) and the seal 24 is formed of a plastic material in the shape of a circle generally and having a diameter of about 25.4 millimeters (25.4 mm). Thus in one embodiment the area of the seal 24 with a reusable adhesive on one side thereof, is about sixty-five (65) times the area of the aperture 22 to be closed via the seal 24. In other embodiments, a ratio of the area of the seal 24 relative to the area of the aperture 22 may be less and in a range between about 24 to about 65 or more. In other embodiments a single use seal may be used wherein an area of the seal may be only slightly larger than the area of the aperture 22 for closing the aperture in a leak proof manner.

In the illustrated embodiment, the seal 24 defines a protrusion 24A extending outwardly from a circumference of the seal for grasping the seal and facilitating removal and/or installation or otherwise handling of the seal. In the illustrated embodiment the protrusion 24A is made of the same material as the seal and formed integral therewith. In one embodiment, the protrusion 24A extends outwardly from the circumference of the seal 24 approximately 3 mm and defines a generally rectangular or trapezoidal shaped tab having a width of about 2-3 mm. In one embodiment the protrusion 24A includes an adhesive on one side thereof the same as the remainder of the seal 24. Alternatively, in other embodiments, the protrusion 24A does not have an adhesive disposed on either side thereof so the protrusion 24A does not adhere to the lid 16 which may better facilitate grasping and removing the seal 24 from lid 16.

Referring to FIG. 1, the apparatus 10 includes a transfer assembly 50 including the lid 16, a tube 26 and a second cup 28 attached to the tube. The tube 26 defines a first end 29 and an opposing second end 31. The second end 31 can be inserted through the aperture 22 located in the lid 16 such that the second end of tube 26 may be submerged in a liquid specimen contained in the specimen cup 12 when the lid is coupled to the specimen cup. The tube 26 is supported in an upright position relative to the specimen cup 12 by contact with the collar 20. In the illustrated embodiment, the tube 26 fits snugly within the aperture 22 so that there is a leak proof seal formed between the tube 26 and lid 16 and so that the tube 26 is positioned generally perpendicular to the opening 14 in the specimen cup 12 when the tube is coupled to the lid 16 and the lid is attached to the specimen cup. This snug fit arrangement between the lid 16 and the tube 26 provides a coupling between the tube 26 and the lid 16 so that transfer assembly 50 stays together as one unit which can be picked up and handled without the tube 26 falling apart from the lid 16. Additionally, in one embodiment, the second cup 28 (described following) is also attached to the tube 26 so that the entire transfer assembly 50 is provided as an assembly of coupled together parts. However, it is not necessary that an outer wall of the tube 26 form an air tight or leak proof seal with the aperture 22 within the collar 20. Thus, in other embodiments the tube 26 can be loose fit within the collar 20 and still maintain the second cup 28 in a generally upright position.

In one embodiment, the tube 26 defines a length sufficient so that the second end 31 of the tube may be positioned within the aperture 22 such that the second end 31 of the tube extends all the way to the interior bottom of the specimen cup 12 for allowing transfer of substantially the entire contents from the specimen cup 12 via the tube 26. In the FIG. 1 embodiment the second end 31 of tube 26 is flat and generally perpendicular to a length of the tube.

Figure 4:
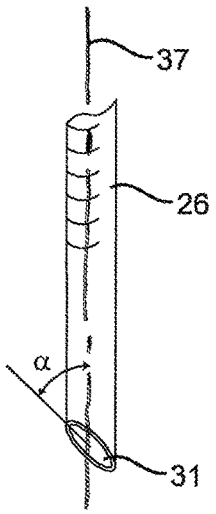
FIG. 4 is a partial side view of another embodiment of a tube in accordance with the present invention.
Figure 5:
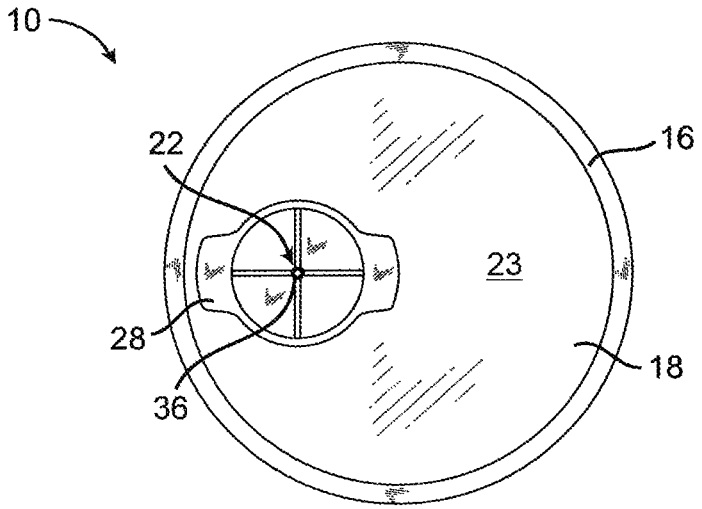
FIG. 5 is a top view of the apparatus of FIG. 1.

Referring to FIG. 4, in another embodiment, the second end 31 of tube 26 is angular and defines an angle alpha relative to the long axis 37 of the tube, the angle alpha being in a range between about 90 degrees and about 45 degrees and configured to prevent blockage of the second end 31 of the tube 26 by the flat bottom 27 of specimen cup 12.

Referring again to FIG. 2, a first end 29 of the tube 26 passes through and is affixed to the bottom 34 of a cup 28. As shown in FIG. 2, the cup 28 includes a nipple 41 extending outwardly from the bottom of the cup. In the FIG. 2 embodiment, the nipple is formed integral with the cup 28. The nipple 41 defines a hole through the nipple and the bottom 34 of the cup 28 for receiving the tube 26 therethrough. The first end 29 of the tube is inserted into the hole in nipple 41 and sealably fixed thereto. In the FIG. 2 embodiment, a needle 36 protrudes from the first end 29 of tube 26 and is affixed thereto. The needle 36 is configured to pierce a seal of an evacuated vial (not shown) for transferring a liquid specimen contained in the specimen cup 12 through the tube 26 and into the vial. In another embodiment (not shown) the first end 29 of tube 26 may extend through the nipple 41 and define a pointed end that extends into the interior of cup 28 for engagement with a vial. Thus the needle 36 may be omitted in some embodiments of the apparatus 10. The needle 36 extends into the cup 28 such that potential spillage of a specimen from the first end 29 of tube 26 disposed therein is contained within the cup. A tip 38 of the needle 36 is disposed within the cup 28 thereby to prevent spillage of specimen outside the cup 28 and potential injury to or contamination of a user, such as a lab technician, from puncture by the needle 36. By preventing a technician from contacting the needle 36, the disposition of the needle 36 inside the cup 28 also prevents a technician from contaminating the specimen.

The cup 28 defines an open top 40 for receiving a vial therein. Thus, an inside diameter of cup 28 is configured for receiving a vial therein for inserting the vial in cup 28 and transferring the specimen to the vial as will be disclosed further hereinafter. Depending on the size of the specimen cup 12 and the size of a vial (not shown) intended to be used with the apparatus 10, the diameter of the cup 28 may be sized accordingly. Thus, the diameter of the cup 28 should be at least slightly larger than the diameter of the vial. As mentioned above, a height of the cup 28 should be at least longer than a length of the needle 36 extending into the cup.

Figure 7:
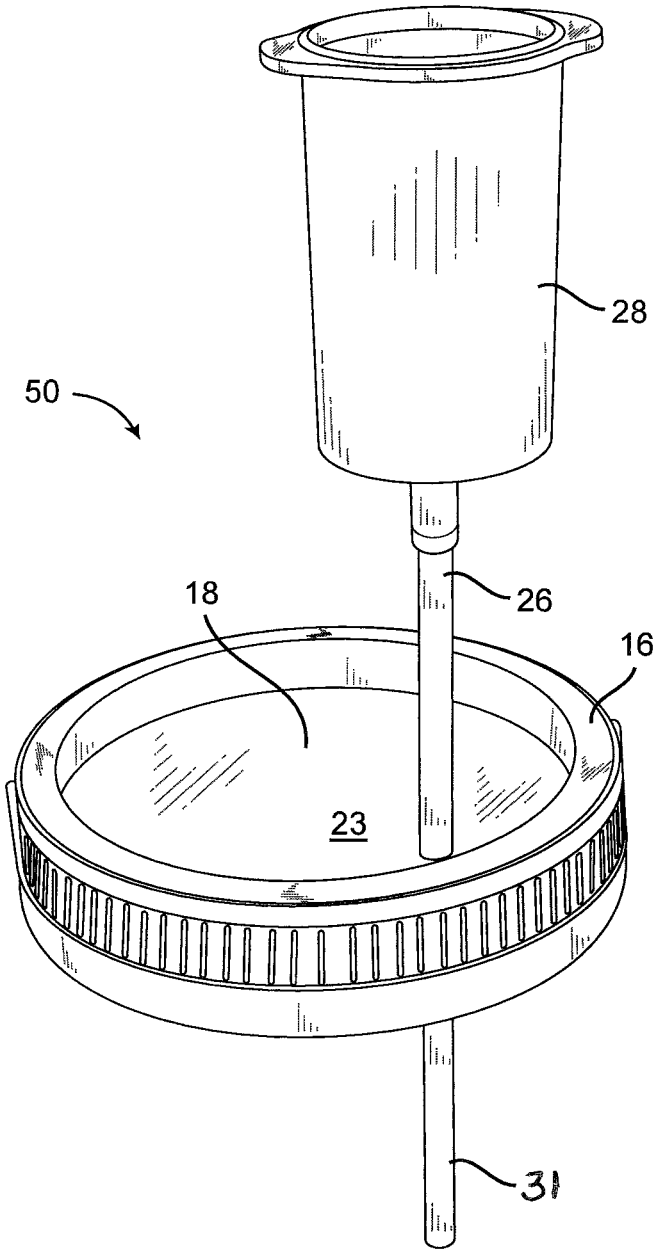
FIG. 7 is a perspective view of one embodiment of a transfer assembly in accordance with the present invention.

FIG. 7 illustrates an embodiment of a specimen transfer assembly 50 according to the present invention. The transfer assembly 50 includes a lid 16, tube 26 inserted through the aperture 22 in the lid and the transfer cup 28 attached to the first end of the tube 26 as described above. The transfer assembly 50 is configured for use with commercially available specimen cups and can be coupled thereto via the threads 17 defined by the lid 16.

In use of apparatus 10, the specimen cup 12 may be provided to a patient for depositing a liquid specimen such as urine in the specimen cup 12 via opening 14. The lid 16 may be placed on the specimen cup 12 via the threads 15, 17 for attaching the lid to the specimen cup and sealing the opening 14 thereof. The seal 24 may be attached to the center portion 18 of the lid 16 and used to seal the aperture 22 in the lid for transporting and/or storage of the specimen within the specimen cup 12.

Thereafter, to transfer the specimen from the specimen cup 12 to an evacuated vial (not shown), the seal 24 must be removed from covering the aperture 22 in the lid. The transfer assembly 50 is then coupled to the lid 16 by inserting the second end 31 of tube 26 through the aperture 22 and into the specimen cup via the opening 14 therein. The second end 31 of the tube 26 being pushed through the lid 16 so the end thereof extends at least into and is covered by a liquid specimen (not shown) contained within the specimen cup 12. The transfer assembly 50 being positioned as shown in FIG. 1 so that the tube 26 extends outwardly from the specimen cup 12 in an upright position and generally perpendicular with the opening 14 of the specimen cup 12. The cup 28 also being generally in an upright position so that the opening 40 thereof is disposed substantially parallel to the opening 14 of specimen cup 12. A vial (not shown) to which the specimen is to be transferred may typically be covered at the top with a penetrable seal.

To carry out the transfer, a vial as described above (not shown) is placed top down into the opening 40 of cup 28 of the transfer assembly 50. A technician pushes the evacuated vial downwards against the needle 36 until the tip 38 of the needle 36 penetrates the seal of the evacuated vial forming a continuous channel between the evacuated vial and the second end 31 of the tube 26 submerged in the specimen. Once a sealed channel is formed, a sample of the specimen from the specimen cup 12 is transferred to the sample vial by suction. After a volume of the sample is transferred to the sample vial, the vial may be removed from the apparatus 10 by the technician by pulling the vial away from the needle 36 and out of the cup 28. This procedure may be repeated as needed to obtain additional samples.

Once transfer of one or more samples is complete, the tube 26 attached to the cup 28 may be removed from the collar 20 of the lid 16 by application of minimal force by the technician. In one embodiment, any spillage of the specimen which may occur as the result of removal of the tube 26 from the specimen cup 12 is contained within the concave center portion 18 of the lid 16 and is thereby controlled preventing contamination of the laboratory space and the technician. Any spillage thus contained may be cleaned by procedures well known in the art.

In the embodiment shown in FIG. 2, the aperture 22 is displaced from the center of the center portion 18 of the lid 16 thereby minimizing the possibility that potentially contaminated spillage of the specimen collected on the concave surface 18 of the lid 16 will fall back into the specimen cup 12 through the open aperture 22. In one embodiment, the specimen cup 12 may be sealed by placing the seal 24 over the aperture 22. The tube 26 and cup 28 of transfer assembly 50 may then be disposed of properly by means well known in the art. The specimen remaining in the sealed specimen cup 12 may be stored for potential future use without the need for further manipulation or may be disposed of safely without spillage.

Example embodiments thus being described, it will be appreciated by one skilled in the art that example embodiments may be varied through routine experimentation and without further inventive activity. Variations are not to be regarded as a departure from the spirit and scope of the exemplary embodiments, and all such modifications as would be obvious to one skilled in the art are intended to be included within the scope of the following claims.

What is claimed is:

1. An apparatus for collecting, storing and transferring a liquid specimen, the apparatus comprising:

a first cup defining an opening for collecting a liquid specimen therein;

a lid attachable to the first cup for closing the opening, the lid defining a concave center portion and including a collar protruding outwardly from a bottom side of the center portion, the lid and the collar collectively defining an aperture extending through the lid and a length of the collar;

a transfer assembly comprising:

a tube having first and second ends, the first end defining a point, the second end being insertable through the aperture in the collar for transferring a liquid specimen from the first cup through the tube; the tube defining an outer diameter approximately the same size as a diameter of the aperture so that when the tube is inserted through the collar the tube fits snugly within the aperture coupling the tube to the lid and forming a leak proof seal between the tube and the collar, the tube being supported by the collar so that the tube extends generally perpendicular to the center portion of the lid when the tube is coupled to the lid via the collar;

the tube being supported by the collar in an upright position relative to the first cup when the second end of the tube is inserted through the collar and into the first cup;

the tube defining a length so that the first end of the tube extends above the center portion of the lid when the second end of the tube is inserted through the collar of the lid and extends into the first cup;

a second cup having a bottom and defining an open top, the first end of the tube extending through the bottom of, and into the second cup, the tube being sealably attached to the bottom of the second cup;

the pointed first end of the tube insertable into an evacuated vial for transferring the liquid specimen to the vial; and the transfer assembly being removably attached to the lid via the sealed coupling between the tube and the collar.

2. The apparatus of claim 1 wherein the lid defines a center, the collar being displaced from the center of the lid.

3. The apparatus of claim 1 wherein the tube further comprises a needle attached to the tube, the needle forming the first end of the tube.

4. The apparatus of claim 1 further comprising a seal for closing the aperture in the lid when the tube is removed from the aperture.

5. The apparatus of claim 4 wherein the seal further comprises a plastic material adhereable to a surface of the lid surrounding the collar for sealing the aperture in the lid.

6. The apparatus of claim 5 wherein the seal further comprises a releasable adhesive on a side thereof for removably attaching the seal to the lid.

7. The apparatus of claim 1 wherein the second end of the tube is formed at an angle between about 45 degrees and about 90 degrees relative to a longitudinal axis of the tube.

8. The apparatus of claim 1 wherein the collar extends outwardly from the lid in a range between about 3 mm and about 8 mm.

9. An apparatus for transferring a liquid specimen from a specimen cup, the apparatus comprising:

a lid attachable to a specimen cup for closing an opening, the lid defining a concave center portion and including a collar protruding outwardly from a bottom side of the center portion, the lid and the collar collectively defining an aperture extending through the lid and a length of the collar;

a transfer assembly comprising:

a tube having first and second ends, the first end defining a point, the second end being insertable through the aperture in the collar for transferring a liquid specimen from the specimen cup through the tube; the tube defining an outer diameter approximately the same size as a diameter of the aperture so that when the tube is inserted through the collar the tube fits snugly within the aperture coupling the tube to the lid and forming a leak proof seal between the tube and the collar, the tube being supported by the collar so that the tube extends generally perpendicular to the center portion of the lid when the tube is coupled to the lid via the collar;

the tube being supported by the collar in an upright position relative to the specimen cup when the second end of the tube is inserted through the collar and into the specimen cup;

the tube defining a length so that the first end of the tube extends above the center portion of the lid when the second end of the tube is inserted through the collar of the lid and extends into the specimen cup;

a second cup having a bottom and defining an open top, the first end of the tube extending through the bottom of, and into the second cup, the tube being sealably attached to the bottom of the second cup;

the pointed first end of the tube being insertable into an evacuated vial for transferring the liquid specimen to the vial; and the transfer assembly being removably attached to the lid via the sealed coupling between the tube and the collar.

10. The apparatus of claim 9 wherein the center portion of the lid has a center and the collar is displaced from the center of the center portion.

11. The apparatus of claim 9 wherein the tube further comprises a needle attached to the tube, the needle forming the first end of the tube.

12. The apparatus of claim 9 further comprising a seal for closing the aperture in the lid when the tube is removed from the lid.

13. The apparatus of claim 12 wherein the seal further comprises a plastic material adhereable to a surface of the lid surrounding the collar for sealing the aperture in the lid.

14. The apparatus of claim 13 wherein the seal further comprises a releasable adhesive on a side thereof for removably attaching the seal to the lid.

15. The apparatus of claim 9 wherein the second end of the tube is formed at an angle between about 45 and about 90 degrees relative to a longitudinal axis of the tube.

16. The apparatus of claim 9 wherein the collar extends outwardly from the lid in a range between about 3 mm and about 8 mm.

* * * * *